US011136992B2

(12) United States Patent
Post

(10) Patent No.: US 11,136,992 B2
(45) Date of Patent: Oct. 5, 2021

(54) HIGH EFFICIENCY BLOWER HOUSING WITH UNEQUAL SIZE INLET OPENINGS

(75) Inventor: Steven W. Post, Cassville, MO (US)

(73) Assignee: REGAL BELOIT AMERICA, INC., Beloit, WI (US)

( * ) Notice: Subject to any disclaimer, the term of this patent is extended or adjusted under 35 U.S.C. 154(b) by 3213 days.

(21) Appl. No.: 12/851,231

(22) Filed: Aug. 5, 2010

(65) Prior Publication Data

US 2011/0243720 A1 Oct. 6, 2011

(51) Int. Cl.
*F04D 29/42* (2006.01)

(52) U.S. Cl.
CPC ..... *F04D 29/4226* (2013.01)

(58) Field of Classification Search
CPC ..... F04D 29/4226; F04D 29/424
USPC ..... 415/204; 416/187
See application file for complete search history.

(56) References Cited

U.S. PATENT DOCUMENTS 662,395 A 11/1900 Davidson
1,892,930 A 1/1933 Burman
3,775,029 A * 11/1973 Ranz ..... H02K 5/00 392/360
5,746,577 A * 5/1998 Ito et al. ..... 416/178
6,162,016 A * 12/2000 Humbad ..... 415/204
7,500,825 B2 * 3/2009 Hanai ..... 415/204
8,100,637 B2 * 1/2012 Sinzaki ..... 415/119
2008/0127671 A1 * 6/2008 Kim ..... F04D 29/668 62/467
2009/0274551 A1 * 11/2009 Messmer ..... 415/148

FOREIGN PATENT DOCUMENTS

WO WO 2008023752 A1 * 2/2008

* cited by examiner

*Primary Examiner* — Woody A Lee, Jr.
*Assistant Examiner* — Maxime M Adjagbe
(74) *Attorney, Agent, or Firm* — Thompson Coburn LLP

(57) ABSTRACT

An air handler blower assembly includes a blower housing containing a centrifugal fan and a motor mounted on the blower housing and connected to the fan. The blower housing has opposite first and second air inlet openings that are coaxial with the fan, and the first inlet opening is larger than the second inlet opening. The motor is mounted on the blower housing with the motor extending axially through the first inlet opening into the blower housing and into the interior of the fan. The positioning of the motor inside the blower housing and inside the fan reduces the overall axial dimension of the blower assembly. The larger first air inlet opening reduces the losses associated with placing the motor in the first air inlet opening while keeping the second air inlet opening at a smaller size than the first air inlet opening avoids creating buffeting noise and a power/efficiency loss from occurring.

5 Claims, 4 Drawing Sheets

HIGH EFFICIENCY BLOWER HOUSING WITH UNEQUAL SIZE INLET OPENINGS

BACKGROUND OF THE INVENTION

1. Field of the Invention

The present invention pertains to an air handler blower assembly including a blower housing containing a centrifugal fan and a motor mounted on the blower housing and connected to the fan. The blower housing has opposite first and second air inlet openings that are coaxial with the fan, and the first inlet opening has a diameter dimension that is larger than a diameter dimension of the second inlet opening. The motor is mounted on the blower housing with the motor extending axially through the first inlet opening into the blower housing and into the interior of the fan. The larger diameter dimension of the first inlet opening reduces any losses in efficiency that are associated with positioning the motor in the first inlet opening.

2. Description of the Related Art

The typical construction of an air handler blower assembly includes a blower housing containing a fan and a motor connected to the fan and mounted on the blower housing.

The blower housing has a scroll-shaped outer wall and first and second side walls connected to opposite sides of the outer wall. The outer wall and side walls are often constructed of sheet metal. The opposite ends of the outer wall and the pair of side walls surround an air outlet opening of the blower housing. The side walls have air inlet openings that provide for the flow of air into the blower housing in response to rotation of the fan by the motor.

The side walls of the blower housing are often constructed as mirror images of each other in order to reduce manufacturing costs. The side walls are stamped from sheet metal. The same tool is used to stamp out side wall blanks. A pair of side wall blanks are further machined and assembled to the opposite sides of the outer wall in constructing the typical blower housing. With the same tooling being used to stamp out both side walls of a blower housing, the air inlet openings in the side walls of the conventional blower housing have the same interior diameter dimensions. Because the air inlet opening diameter dimensions are the same size in prior art blower assemblies, the air inlet opening on the motor side of the blower assembly is overly restricted resulting in a loss in performance and power.

In the operation of the blower assembly, a minimum air flow velocity through the blower housing air inlet openings is needed to properly feed air to the fan in order for the rotating fan to create sufficient pressure that keeps air moving through the air inlet openings, through the blower housing and through the air outlet opening. If the size of the inlet openings is too large, the air flow through the inlet openings decreases and the fan blades are not properly fed air. As a result, the pressure generated inside the blower housing by the fan decreases. If the air inlet openings are too large the pressure created by the fan can decrease to the point that the blower assembly loses power and buffeting noise is created by the fan blades not being fed the optimum flow of air. To avoid the creation of buffeting noise and pressure loss, the air inlet openings are kept from being excessively large. Conversely, too small of an inlet opening creates a restriction to air flow which can cause a loss in performance efficiency.

SUMMARY OF THE INVENTION

As in a conventional blower assembly, the blower assembly of the invention is comprised of a blower housing, a fan contained in the blower housing, and a motor mounted on the blower housing and connected to the fan.

The fan of the blower assembly is a centrifugal or squirrel cage fan. The fan is comprised of first and second annular end rings and a plurality of blades connected between the end rings. The end rings and the blades surround a cylindrical interior volume of the fan. The fan also comprises a brace in the fan interior volume. The brace is configured as a solid circular plate having an outer peripheral edge that is connected to the fan blades.

The blower housing is comprised of an outer wall and opposite first and second side walls. The outer wall has a scroll-shaped length. The scroll-shaped length extends from a first end edge positioned at one side of the blower housing outlet opening to a second end edge positioned at the opposite side of the blower housing outlet opening.

The first and second side walls are connected to the opposite sides of the blower housing outer wall. Together, the outer wall end edges and the side walls surround the air outlet opening of the blower housing. The first side wall has a first air inlet opening and the second side wall has a second air inlet opening. The first and second side walls are substantially mirror images of each other except for the diameter dimensions of the first and second air inlet openings. The diameter dimension of the first inlet opening is larger than the diameter dimension of the second inlet opening.

The motor has a shaft that is connected to the center of the fan brace. Rotation of the motor shaft rotates the fan in the blower housing. The motor is mounted on the blower housing with the motor extending axially through the first air inlet opening in the first side wall of the housing. In addition, the motor extends axially into the interior volume of the fan. This reduces the overall axial dimension of the blower assembly.

Contrary to the prior art teaching of both air inlet openings in the opposite side walls of a blower housing being the same size to reduce manufacturing/tooling costs, the air handler blower assembly of the present invention includes a blower housing with opposite first and second side walls where a first air inlet opening in the first side wall has a larger diameter dimension than a second air inlet opening in the second side wall.

The positioning of the motor extending through the first air inlet opening into the blower housing and into the fan interior volume reduces the overall axial dimension of the blower assembly. This enables the blower assembly to be employed in smaller air handler enclosures. The positioning of the motor in the first inlet opening also blocks some of the area of the first inlet opening. However, because the diameter dimension of the first inlet opening is larger than the diameter dimension of the second inlet opening, the inflow of air through the first inlet opening is not substantially reduced, resulting in increased efficiency of the blower assembly, while the second inlet opening is maintained at a smaller diameter dimension to avoid creating the problem of buffeting during operation of the blower assembly. Therefore, by going away from the common construction of blower housings with equal size inlet openings in the side walls of the blower housings to avoid buffeting, the motor of the blower assembly of the invention can be axially positioned inside the blower housing and inside the fan interior volume with less performance loss. In summary, the potential problems of buffeting noise and power loss created by excessively large air inlet opening diameter dimensions are avoided by only increasing the diameter dimension of the first air inlet opening.

BRIEF DESCRIPTION OF THE DRAWINGS

Further features of the blower assembly of the present invention are set forth in the following detailed description of the blower assembly and in the drawing figures.

FIG. 3 is an elevation view of the blower assembly showing the outlet opening of the blower assembly.

DETAILED DESCRIPTION OF THE PREFERRED EMBODIMENT

Figure 1:
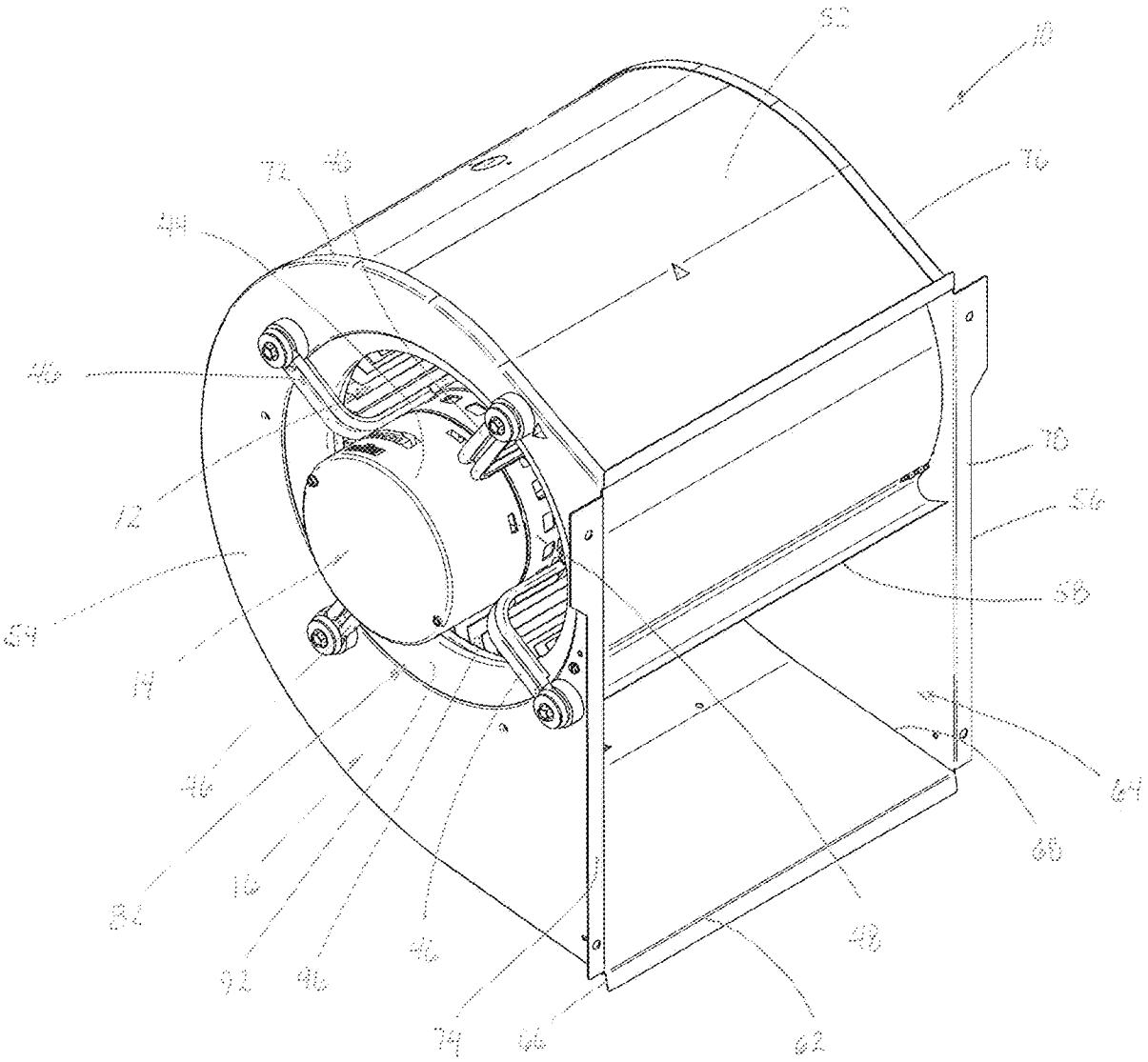
FIG. 1 is a side perspective view of the blower assembly of the invention.
Figure 2:
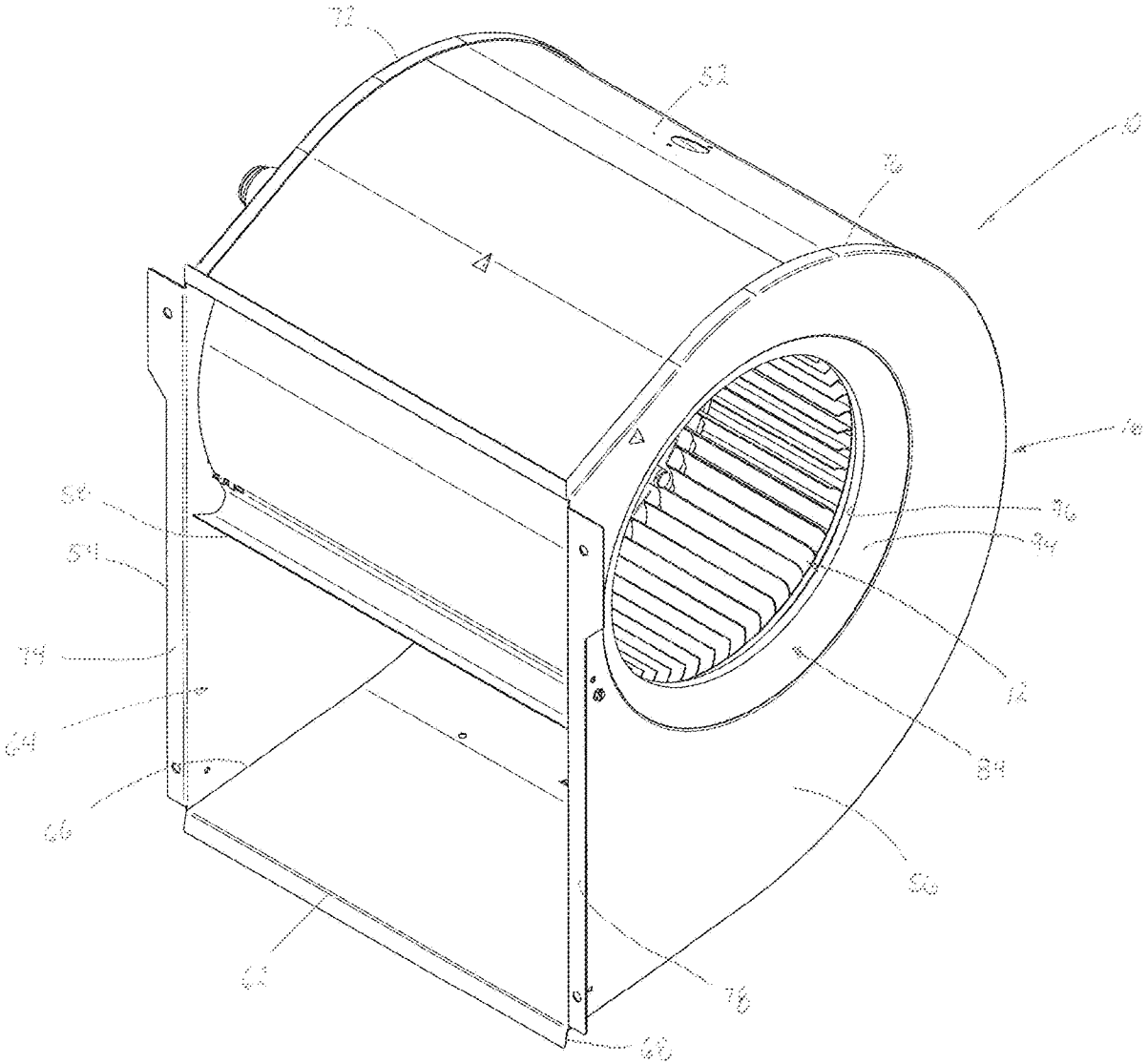
FIG. 2 is a side perspective view of the blower assembly from the opposite side of the blower assembly shown in FIG. 1.
Figure 2:
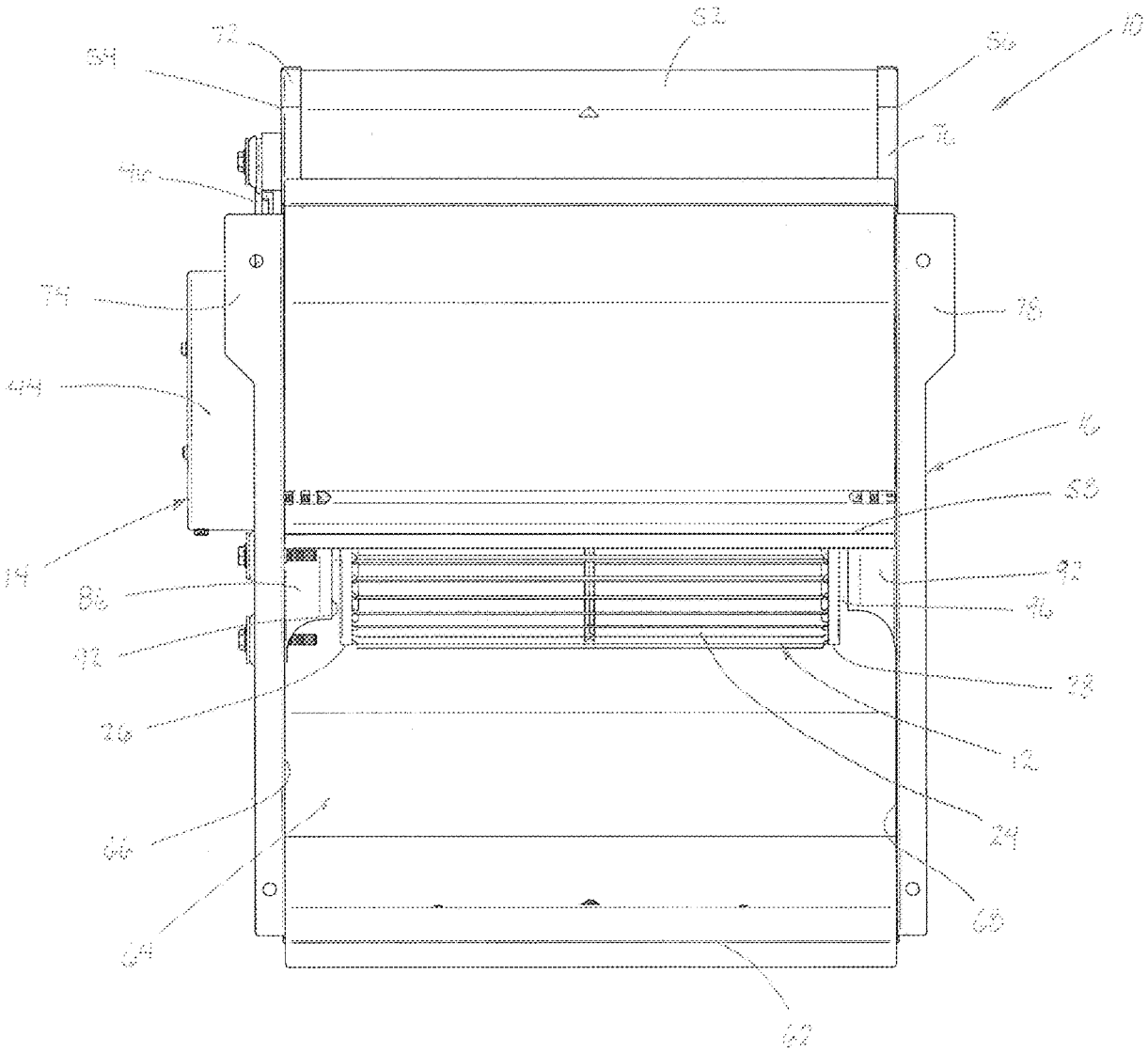

The blower assembly 10 of the present invention is basically comprised of a fan 12, a motor 14 that rotates the fan and a housing 16 that contains the motor and fan. These basic component parts of the blower assembly 10 are constructed of materials typically used in the construction of air handler blower assemblies. Without being limited thereto, the efficiency of the blower assembly 10 of the invention is further optimized by the blower housing 16 being constructed as described in pending patent application Ser. Nos. 11/935,726; 12/178,161 and 12/631,415, which are assigned to the assignee of the present invention and are incorporated herein by reference.

The fan 12 in the preferred embodiment is a centrifugal or squirrel cage fan having a cylindrical configuration with a center axis 22. The center axis 22 defines mutually perpendicular axial and radial directions relative to the blower assembly 10. As in the construction of conventional centrifugal fans, the fan 12 is comprised of a plurality of blades 24 that are radially spaced from the center axis 22 and are circumferentially spaced around the center axis. A first annular end ring 26 and a second annular end ring 28 are connected to the axially opposite ends of the fan blades 24. The annular end rings 26, 28 have center axes that are coaxial with the fan center axis 22. The end rings 26, 28 hold the fan blades 24 in their circumferentially and radially spaced positions around the fan center axis 22 and around a hollow interior volume 32 of the fan. The fan 12 also comprises a brace 34 in the fan interior volume 32. In the embodiment of the fan shown in the drawing figures, the brace 34 is configured as a solid circular plate having a radially outer peripheral edge 36 that is connected to the fan blades 24. The outer peripheral edge 36 of the brace 34 is coaxial with the fan center axis 22. The solid circular plate configuration of the brace 34 could be substituted for by other configurations, for example, a brace having a cylindrical center hub that is connected to a circular rim at the outer periphery of the brace by a plurality of spokes or webs. Furthermore, in the drawing figures, the brace 34 is shown connected to the fan blades 24 at a position of the blades that is axially in the middle of the fan 12. In alternate embodiments, the brace 34 could be axially positioned more toward either the first annular end ring 26 or the second annular end ring 28.

The motor 14 has a shaft 42 that is connected to the center of the brace 34 and is thereby connected to the fan 12. The motor shaft 42 is coaxial with the fan center axis 22. Rotation of the motor shaft 42 rotates the fan 12. As shown in the drawing figures, with the motor shaft 42 connected to the fan brace 34, a significant portion of a casing 44 of the motor is positioned inside the fan interior volume 32. This positioning of the motor 12 at least partially inside the fan interior volume 32 reduces the overall axial dimension of the blower assembly 10.

A plurality of L-shaped arms 46 are connected to the motor casing 44 by an adjustable band 48. The L-shaped arms 46 are arranged around the circumference of the motor casing 44 and include portions that extend radially from the motor casing 44 and are connected to the housing 16. In this manner, the motor 14 is supported by the housing 16.

The blower housing 16 is basically comprised of an outer wall 52 and opposite first 54 and second 56 side walls. The outer wall 52 has a scroll-shaped length that extends from a first end edge 58 of the outer wall around the fan 12 and the fan axis of rotation 22 to a second end edge 62 of the outer wall. The outer wall 52 has parallel first 66 and second 68 side edges that define the width of the outer wall. The outer wall first end edge 58 is formed as the cutoff of the scroll-shaped outer wall 52. As shown in the drawing figures, the outer wall first end edge 58 and second end edge 62 are positioned at opposite sides of the blower housing outlet opening 64.

The first side wall 54 has a scroll-shaped edge portion 72 that is connected to the first side edge 66 of the outer wall. In addition, the first side wall 54 has a straight edge portion 74 that extends along one side of the blower housing outlet opening 64.

In a like manner, the second side wall 56 has a scroll-shaped edge portion 76 that is connected to the second side edge 68 of the blower housing outer wall 52. The second side wall 56 also includes a straight edge portion 78 that extends along the opposite side of the outlet opening 64 from the first side wall straight edge portion 74.

The first 54 and second 56 side walls are substantially mirror images of each other except for the area of a first inlet opening 82 through the first side wall 54 and the area of a second inlet opening 84 through the second side wall 56.

Figure 4:
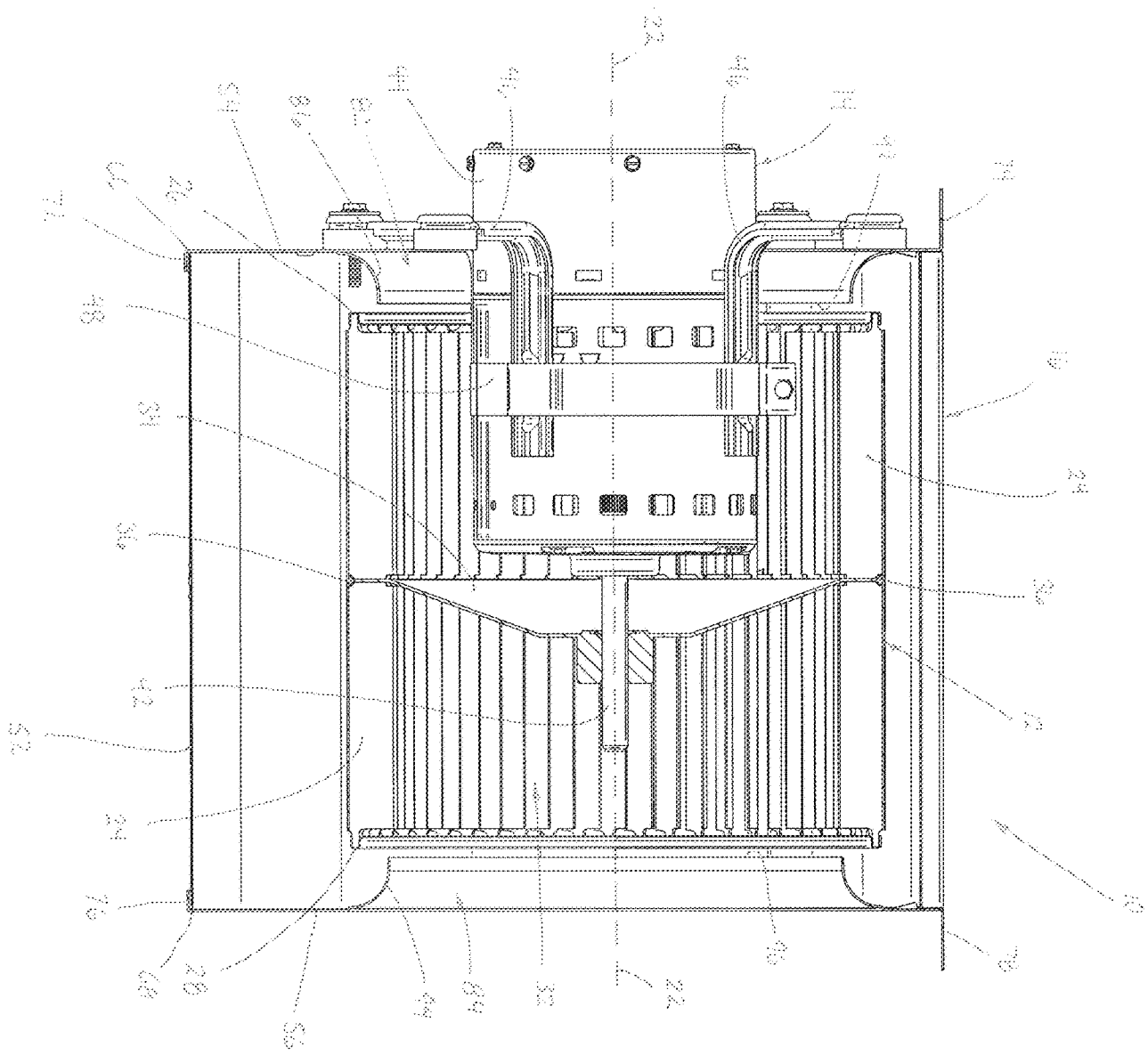
FIG. 4 is a cross section of both the blower housing and the fan of the blower assembly.

As best seen in FIG. 4, the first side wall 54 has an annular portion 86 that curves inwardly into the interior of the blower housing 16 and toward the fan first annular end ring 26. This annular curved portion 86 terminates at a circular inner edge 92 of the first side wall 54. The circular inner edge 92 surrounds the area of the first inlet opening 82. This circular inner edge 92 of the first side wall 54 has a first interior diameter dimension.

In a like manner, the second side wall 56 has an annular portion 94 that curves inwardly into the interior of the blower housing 16 and toward the fan second annular end ring 28. This annular curved portion 94 terminates at a circular inner edge 96 of the second side wall 56. The circular inner edge 96 surrounds the area of the second inlet opening 84. The second side wall circular inner edge 96 has a second interior diameter dimension.

As seen in FIG. 5, the first interior diameter dimension of the first side wall inner edge 92 is larger than the second interior diameter dimension of the second side wall inner edge 96.

In the embodiment of the blower assembly 10 shown in the drawing figures, the L-shaped arms 46 are connected to the first side wall 54. The arms 46 position a portion of the motor 14 axially inside the blower housing 16 and axially inside the fan interior volume 32. In the illustrated embodiment, most of the motor axial length is positioned inside the housing 16. This positioning of the motor 14 inside the housing 16 advantageously reduces the overall axial dimension of the blower assembly 10. This enables the blower assembly to be employed in smaller air handler enclosures.

The positioning of the motor 14 also blocks some of the area of the first inlet opening 82. However, because the diameter dimension of the first inlet opening 82 is larger than the diameter dimension of the second inlet opening 84, the areas for the inflow of air through the first inlet opening 82 and through the second inlet opening 84 allow both sides of the blower assembly 10 to operate at optimum efficiency and power.

Therefore, by going away from the common construction of blower housings with equal size inlet openings in the side walls of the blower housings to avoid buffeting and increase efficiency, the motor 14 of the blower assembly 10 of the invention can be axially positioned inside the blower housing 16 and inside the fan interior volume 32 at a lesser sacrifice of efficiency.

As various modifications could be made in the constructions of the blower assembly herein described and illustrated without departing from the scope of the invention, it is intended that all matter contained in the foregoing description or shown in the accompanying drawings shall be interpreted as illustrative rather than limiting. Thus, the breadth and scope of the present invention should not be limited by any of the above-described exemplary embodiments, but should be defined only in accordance with the following claims appended hereto and their equivalents.

What is claimed is:

1. An air handler blower assembly comprising:

a centrifugal fan having a plurality of blades and a center axis of rotation that defines mutually perpendicular axial and radial directions relative to the blower assembly, the fan having axially opposite first and second ends;

a motor having a motor casing, the motor being operatively connected to the fan for rotation of the fan relative to the motor casing in response to operation of the motor;

a blower housing containing the fan, the blower housing having an outer wall and first and second side walls at axially opposite sides of the outer wall, the outer wall extending around the fan, the first side wall having a first air inlet opening with a first diameter dimension, the second side wall having a second air inlet opening with a second diameter dimension, and the first diameter dimension being larger than the second diameter dimension, the first and second air inlet openings being sized such that during operation of the blower assembly, air flow rate through the first air inlet opening is substantially equal to air flow rate through the second air inlet opening, the first end of the fan being adjacent the first air inlet opening and the second end of the fan being adjacent the second air inlet opening, the plurality of blades surrounding and defining a cylindrical interior volume extending from the first end of the fan to the second end of the fan;

at least one support arm operatively securing the motor to the blower housing, the at least one support arm extending into the first air inlet opening such that at least a substantial portion of the at least one support arm is within the cylindrical interior volume of the fan.

2. The blower assembly of claim 1, further comprising:

the first side wall having a circular first inner edge that surrounds the first air inlet opening, the first inner edge having a center axis that is coaxial with the fan center axis; and, the second side wall having a circular second inner edge that surrounds the second air inlet opening, the second inner edge having a center axis that is coaxial with the fan center axis.

3. The blower assembly of claim 1, wherein:

the fan has a brace intermediate the first and second ends of the fan, the brace being a circular plate with a center axis that is coaxial with the fan center axis.

4. The blower assembly of claim 1, further comprising:

the outer wall having a scroll-shaped length with opposite first and second end edges and a width with opposite first and second side edges, the outer wall length spiraling around the fan as the outer wall length extends from the first end edge to the second end edge, the outer wall first and second end edges being positioned on opposite sides of an outlet opening of the blower housing;

the first side wall being connected to the outer wall first side edge and the second side wall being connected to the outer wall second side edge with the first and second side walls being positioned on opposite sides of the outlet opening.

5. The blower assembly of claim 1, further comprising:

the motor having an axial length and most of the motor axial length being positioned inside the blower housing between the first and second side walls.

* * * * *